US009528217B2

(12) United States Patent
Tian et al.

(10) Patent No.: US 9,528,217 B2
(45) Date of Patent: Dec. 27, 2016

(54) DRAINAGE AND FILTERING SYSTEM FOR WASHING MACHINE AND WASHING MACHINE WITH THE DRAINAGE AND FILTERING SYSTEM

(71) Applicants: HAIER GROUP CORPORATION, Qingdao, Shandong (CN); QINGDAO HAIER WASHING MACHINE CO., LTD., Qingdao, Shandong (CN)

(72) Inventors: Yun Tian, Shandong (CN); Feng Li, Shandong (CN); Wenting Xu, Shandong (CN); Gangjin Zhang, Shandong (CN); Chunxia Zhou, Shandong (CN)

(73) Assignees: HAIER GROUP CORPORATION, Qingdao, Shandong (CN); QINGDAO HAIER WASHING MACHINE CO., LTD., Qingdao, Shandong (CN)

( * ) Notice: Subject to any disclaimer, the term of this patent is extended or adjusted under 35 U.S.C. 154(b) by 0 days.

(21) Appl. No.: 14/683,703

(22) Filed: Apr. 10, 2015

(65) Prior Publication Data

US 2015/0211172 A1 Jul. 30, 2015

Related U.S. Application Data

(63) Continuation of application No. PCT/CN2012/083699, filed on Oct. 29, 2012.

(51) Int. Cl.
*D06F 39/10* (2006.01)
*D06F 39/08* (2006.01)

(52) U.S. Cl.
CPC ..... *D06F 39/10* (2013.01); *D06F 39/083* (2013.01)

(58) Field of Classification Search
CPC .... D06F 39/10; D06F 39/083; A47L 15/4225; A47L 15/4204; A47L 15/4208
(Continued)

(56) References Cited

U.S. PATENT DOCUMENTS

| | | | | |
|---|---|---|---|---|
| 2,687,216 | A | 8/1954 | Shelton | |
| 4,125,003 | A | 11/1978 | Wasemann | |
| 6,568,017 | B2 * | 5/2003 | Cheo | D06F 37/262 68/208 |

FOREIGN PATENT DOCUMENTS

| | | | |
|---|---|---|---|
| CN | 101962896 | A | 2/2011 |
| DE | 1710562 | A1 | 11/1971 |

(Continued)

OTHER PUBLICATIONS

Siemens, "Strainer for the solution container of a washing machine or a dishwashing machine" Nov. 1964, FR 1380081 Machine Translation.*

(Continued)

*Primary Examiner* — David Cormier
*Assistant Examiner* — Thomas Bucci
(74) *Attorney, Agent, or Firm* — Tim Tingkang Xia, Esq.; Locke Lord LLP

(57) ABSTRACT

In one aspect of the invention, a drainage and filtering system for a washing machine comprises an outer barrel, and a filtering apparatus, where a groove is defined at the bottom of the outer barrel, the bottom of the groove is provided with a drainage port, the filtering apparatus is mounted in the groove and covers the upper part of the drainage port, the filtering apparatus is provided with at least one filtering passage leading to the drainage port, and a foreign material stop structure is arranged in the filtering passage.

9 Claims, 4 Drawing Sheets

(58) Field of Classification Search
USPC ..... 68/18 F, 208, 12.13, 13 R, 3 R, 58, 12.14,68/142, 139, 1; 134/56 D, 111, 104.1, 104.2, 134/104.4, 58 D, 186, 110; 210/167.01, 232, 210/238, 497.01, 346, 460, 196, 314, 454
See application file for complete search history.

(56) References Cited

FOREIGN PATENT DOCUMENTS

| | | | | | |
|---|---|---|---|---|---|
| DE | 8534059 | U1 | | 1/1987 | |
| EP | 2280112 | A1 | | 2/2011 | |
| FR | 1380081 | A | | 10/1964 | |
| FR | 1380081 | A | * | 11/1964 | ..... A47L 15/4202 |
| FR | 2190966 | A1 | | 2/1974 | |

OTHER PUBLICATIONS

International Search Report dated Apr. 4, 2013 for Application No. PCT/CN2012/083699.

* cited by examiner

DRAINAGE AND FILTERING SYSTEM FOR WASHING MACHINE AND WASHING MACHINE WITH THE DRAINAGE AND FILTERING SYSTEM

CROSS-REFERENCE TO RELATED APPLICATION

This application is a continuation application of PCT Patent Application No. PCT/CN2012/083699, filed Oct. 29, 2012, which is incorporated herein in its entirety by reference.

FIELD OF THE INVENTION

The present invention relates generally to the field of washing machines, and more particularly, to a filtering system for a washing machine, and more particularly to a drainage and filtering system for a washing machine and a washing machine with the drainage and filtering system of same that prevents entrance of foreign materials.

BACKGROUND OF THE INVENTION

The background description provided herein is for the purpose of generally presenting the context of the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the present invention.

An impeller washing machine in the prior art usually includes a cabinet, an outer barrel suspended in the cabinet, an inner barrel provided in the outer barrel and actuated by an external rotating shaft to rotate, and an agitator connected to the bottom of the inner barrel through an inner rotating shaft. The bottom of the outer barrel is provided with a drainage valve, and a water inlet of the drainage valve is connected to a drainage port arranged at the bottom of the outer barrel. A filter is usually provided on the wall of the inner barrel, and filters lint passively through water flow during washing. A water pump is provided at the bottom of the outer barrel. A water inlet of the water pump is connected to a drainage pipe at the bottom of the outer barrel. A drainage port of the water pump is connected to a pipe leading to the inner barrel of the washing machine. During washing, when a motor drives the agitator to actuate laundry to rotate, a cyclic water pump runs to recycle washing water at the bottom of the outer barrel and discharge the washing water back to the inner barrel. The filter is provided at a water outlet of a connecting pipe of the water pump to filter lint and impurities in drain water from washing. The washing water that has been filtered may flow back to the inner barrel to clean the washing water. Such filtering apparatus is generally a flexible filtering mesh bag or a rigid filtering frame. After a period of time of use, lint and impurities in the filtering apparatus must be manually removed, otherwise the filtering apparatus would be clogged and bacteria would grow. In addition, when the washing water with lint and impurities enters the water pump, lint and impurities wind on the parts of the water pump. Relatively rigid foreign materials such as paper clips, hair clips or coins may easily cause the failure of the water pump appear. Moreover, damages caused by foreign materials to the water pump cannot be prevented if the filter is arranged on the outlet of the water pump.

Therefore, many manufacturers have made improvements to the foregoing structure. Chinese Patent Application No. 200420120524.6 discloses a cyclic pipe of an inner circulation washing machine, which includes: an outer barrel drainage port arranged at the bottom of an outer barrel, an inner circulation outlet arranged at the top of the outer barrel for sending filtered circulating water into an inner barrel for recycling, an inner circulation pipe for connecting the outer barrel drainage port and the inner circulation outlet, and an inner circulation pump arranged between the outer barrel drainage port and the inner circulation outlet for pressing washing water discharged from the outer barrel drainage port into the inner barrel again, where at least one filtering apparatus is arranged at an input end of the inner circulation pump, which is at the bottom of the outer barrel. The filtering apparatus is for collecting lint and/or paper shreds in circulating water and may be detached for cleaning. However, the structure is relatively complex and has a relatively high requirement of improving the inner circulation pipe. Moreover, the inner circulation pipe is arranged at the bottom of the outer barrel, and the connection between the filtering apparatus and the pipe loosens with the vibration of the outer barrel, which easily causes an undesirable filtering effect of the filtering port, or even causes some foreign materials to directly pass through the filtering apparatus and cannot be completely filtered, resulting in damages to the water pump.

Chinese Patent Application No. 200610036929.5 discloses a washing machine with a cyclic water pump. The washing machine includes an outer barrel suspend in a cabinet and an inner barrel located in the outer barrel and actuated by an external rotating shaft to rotate, and a drainage passage for discharging water in the outer barrel out of the cabinet. The upstream of a water inlet of the water pump is connected with the bottom of the outer barrel, and the downstream of a drainage port at the bottom of the outer barrel is connected with a pipe leading to the inner barrel of the washing machine. A filtering apparatus is provided at the upstream of the water inlet of the water pump, and a filtering surface of the filtering apparatus is arranged at the drainage passage and close to the upstream of the water inlet of a drainage valve. After long term use, the structure may easily cause lint to clog the filtering apparatus.

Moreover, an impeller washing machine with a drainage pump discharges water in the washing machine under the effect of the drainage pump. However, no effective filtering apparatus is provided. And after long term use of the washing machine, a large quantity of foreign materials enters a drainage valve or the drainage pump and cannot be removed. In severe cases, foreign materials may result in a drainage apparatus not discharging waste water, causing inconvenience or even economical loss to a user.

Therefore, a heretofore unaddressed need exists in the art to address the aforementioned deficiencies and inadequacies.

SUMMARY OF THE INVENTION

One of the objectives of the present invention is to provide a drainage and filtering system for a washing machine that has a simple structure, convenient to mount, and can effectively prevent foreign materials from entering a drainage valve or a drainage pump of the washing machine, so as to prevent foreign materials from damaging the drainage valve or the drainage pump.

Another objective of the present invention is to provide a washing machine with the foregoing drainage and filtering system.

In order to solve the technical problems in view of the deficiencies in the prior art, the technical solution of the present invention is as follows.

One aspect of the present invention includes a drainage and filtering system for a washing machine comprises an outer barrel and a filtering apparatus, where a groove is defined at the bottom of the outer barrel, the bottom of the groove is provided with a drainage port, the filtering apparatus is mounted in the groove and covers the upper part of the drainage port, the filtering apparatus is provided with at least one filtering passage leading to the drainage port, and a foreign material stop structure is arranged in the filtering passage.

In one embodiment, the filtering apparatus further comprises an upper cover board matched with the shape of the opening of the groove and multiple baffles arranged on the lower surface of the upper cover board, and the multiple baffles are matched to form a sidewall of the filtering passage and the foreign material stop structure in the filtering passage.

In certain embodiments, the baffles further comprise a sidewall baffle for forming the sidewall of the filtering passage and filtering baffles arranged in the filtering passage, the filtering baffles and the sidewall baffle, or each two filtering baffles and the filtering baffles and the sidewall baffle are matched to form a bent waterway in the filtering passage, the bent waterway is matched with the filtering baffle to form the foreign material stop structure.

In certain embodiments, the bent waterway is a single "<"-shaped bend or continuous bends, and the included angle of each "<"-shaped bend is about 40° to about 90°.

In certain embodiments, at least one notch is defined at the opening of the groove corresponding to an edge of the upper cover board. The notch forms a water inlet of the filtering passage. A water outlet of the filtering passage is connected with the drainage port. The filtering baffle extends from the water inlet of the filtering passage towards the water outlet. Ends of the filtering baffle and the sidewall baffle close to the water inlet are tilted. In certain embodiments, they form smooth structures for lint to pass through easily.

In certain embodiments, the height of the filtering baffle is less than or equal to the height of the sidewall baffle. The filtering apparatus is supported in the groove by the sidewall baffle. In certain embodiments, a gap is defined between the lower surface of the filtering baffle and the bottom of the groove, and the height of the gap is less than or equal to about 3 mm. The structure enables drainage through the gap between the bottom of the filtering baffle and that of the groove, so as to increase the amount of drain water, and moreover, to enable lint stopped by the end of the filtering baffle corresponding to the water inlet to slide with the water flow to the bottom of the groove and discharged to the drainage port through the gap, where the space of the gap can stop foreign materials from entrance and discharged.

In certain embodiments, an annular rib is provided at the lower surface of the upper cover board corresponding to the drainage port. The height of the annular rib is less than that of the filtering baffle. Multiple flow-guiding blades are distributed radially from the center inside the annular rib. An end of the flow-guiding blade has an arc-shaped transition corresponding to the annular rib. The structure prevents water flow from forming a vortex when the water enters the drainage port through the filtering passage, which results in an unstable drain water flow.

In certain embodiments, the height of the flow-guiding blade is greater than that of the annular rib, and is less than that of the filtering baffle.

In certain embodiments, the flow-guiding blade is highest at the intersection in the center. The height at the center is greater than that of the sidewall baffle. The height of the flow-guiding blade decreases radially from the center towards the outside, forming a tapered structure, which enters the drainage port. The annular rib directly decreases to be flat within one half to one third of the radius of the annular rib, and the height of the flat portion of the flow-guiding blade is less than or equal to that of the filtering baffle. The tapered structure further prevents lint that flows near the drainage port from entering the filtering passage again with a vortex water flow to cause a clog.

In certain embodiments, the filtering apparatus is fixed in the groove through a screw. A screw mounting column supporting the upper cover board of the filtering apparatus is provided in the groove, and a screw hole is correspondingly defined on the upper cover board.

In certain embodiments, the circumferential wall of the groove has a slope shape or a step shape from top to bottom. The shape of the sidewall baffle close to the circumferential wall of the groove is matched with that of the circumferential wall of the groove. In certain embodiments, the upper cover board covers the opening of the groove.

In certain embodiments, at least one vertically-through drain water opening is further provided on the upper cover board, and a water inlet circumference of the drain water opening protrudes from the upper surface of the upper cover board. The size of the drain water opening is relatively small and has an arc-shaped slit shape or a small-hole shape. The structure can increase the amount of drain water, and stop foreign materials from passing through.

In another aspect, the present invention further provides a washing machine with the filtering apparatus of same. The drainage system of the washing machine includes a drainage port and a drainage valve or a drainage pump, and the filtering apparatus is provided above the drainage port. During drainage of the washing machine, the drainage system is turned on, water in an outer barrel enters the drainage port of the outer barrel from a water inlet of a filtering passage around the filtering apparatus and a drain water opening above an upper cover board. In the process of discharging water, the filtering apparatus of the present invention can effectively perform the filtering function, and relatively rigid foreign materials such as paper clips, hair clips or coins that cannot be discharged by the pump when drain water passing through the filtering apparatus can all be effectively filtered.

After the technical solution is adopted, the present invention has the following beneficial effects.

The present invention uses an effective space at the drainage port on the inner side of an outer barrel and designs a filtering apparatus, where the filtering apparatus has a simple structure, convenient to mount, integrated through injection molding, and has a low production cost. Water and lint can be effectively discharged from the outer barrel, and meanwhile foreign materials may be further effectively prevented from entering the drainage valve or drainage pump through the drainage port, thereby preventing the foreign materials from entering the drainage apparatus to damage the drainage valve or drainage pump, which results in the drainage of a washing machine out of control.

These and other aspects of the present invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
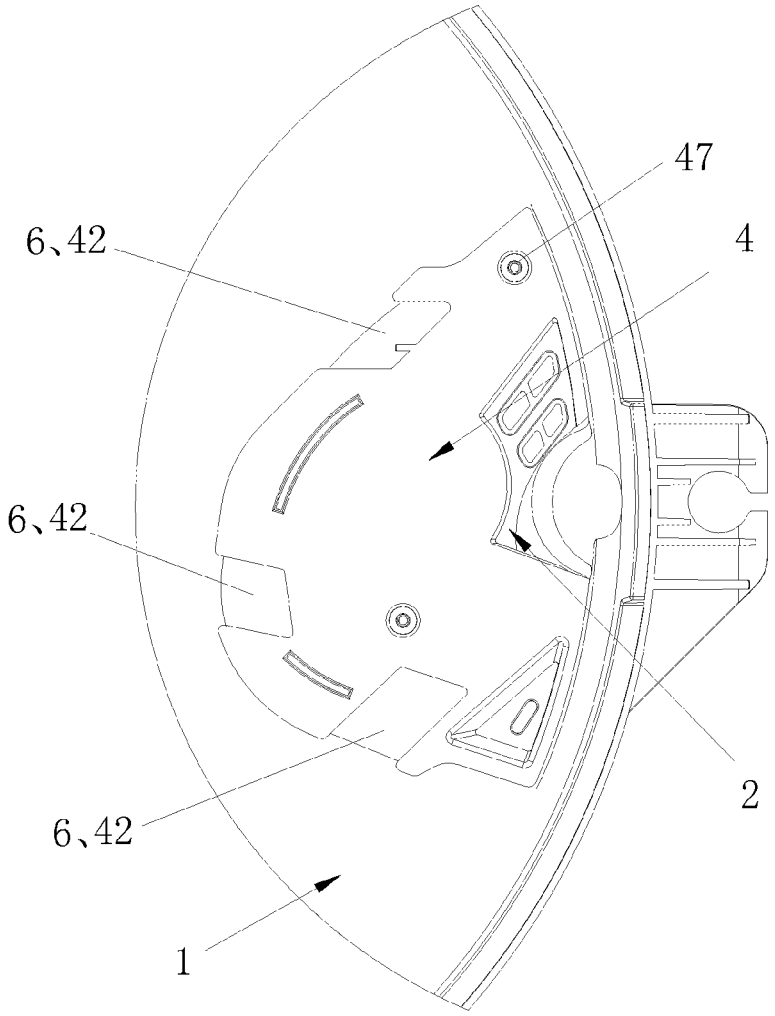
FIG. 1 is a schematic structural view of a filtering apparatus mounted at the bottom of an outer barrel of a washing machine according to one embodiment of the present invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

The description will be made as to the embodiments of the invention in conjunction with the accompanying drawings in FIGS. 1-5. In accordance with the purposes of this invention, as embodied and broadly described herein, this invention, in certain aspects, relates to a filtering system for a washing machine, and more particularly to a drainage and filtering system for a washing machine and a washing machine with the drainage and filtering system of same that prevents entrance of foreign materials.

In certain embodiments, as shown in FIGS. 1-5, a groove 2 is defined at the bottom of an outer barrel 1 of the washing machine according to the present invention. A drainage port 3 is arranged at the bottom of groove 2. A filtering apparatus 4 is mounted in groove 2 and covers the upper part of the drainage port 3. The filtering apparatus 4 is provided with at least one filtering passage 5 leading to the drainage port 3, and a foreign material stop structure is arranged in the filtering passage.

Figure 5:
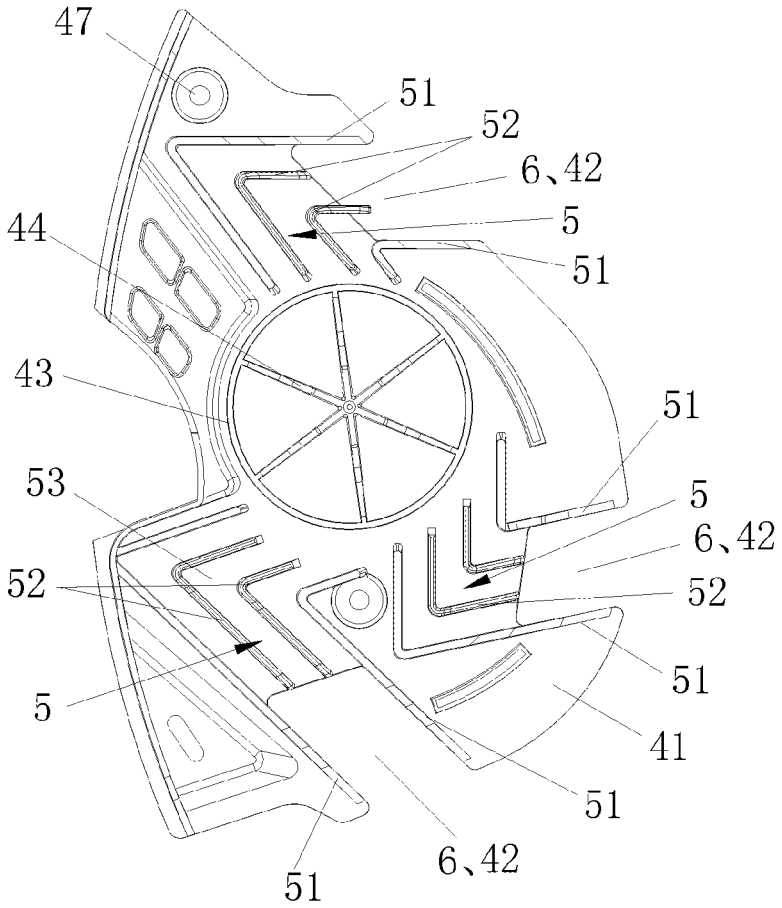
FIG. 5 is a schematic view of the lower surface of the upper cover board of the filtering apparatus according to one embodiment of the present invention.

In one embodiment, as shown in FIG. 5, the filtering apparatus 4 includes an upper cover board matched with the shape of the opening of the groove 41, a sidewall baffle 51 arranged on the lower surface of the upper cover board 41 for forming the sidewall of the filtering passage 5, and filtering baffles 52 arranged in the filtering passage 5. The filtering baffles 52 and the sidewall baffle 51, or each two filtering baffles 52 and the filtering baffles 52 and the sidewall baffle 51 are matched to form a bent waterway 53 for connecting the outer barrel inside and the drainage port. The bent waterway 53 is matched with the filtering baffle 52 to form a foreign material stop structure. The foreign material stop structure can stop relatively rigid foreign materials such as paper clips, hair clips or coins, and lint flows in the drainage port through the bent waterway with the water flow. In certain embodiments, the bent waterway is a single "<"-shaped bend or continuous bends, and the included angle of each "<"-shaped bend is about 40° to about 90°.

Figure 3:
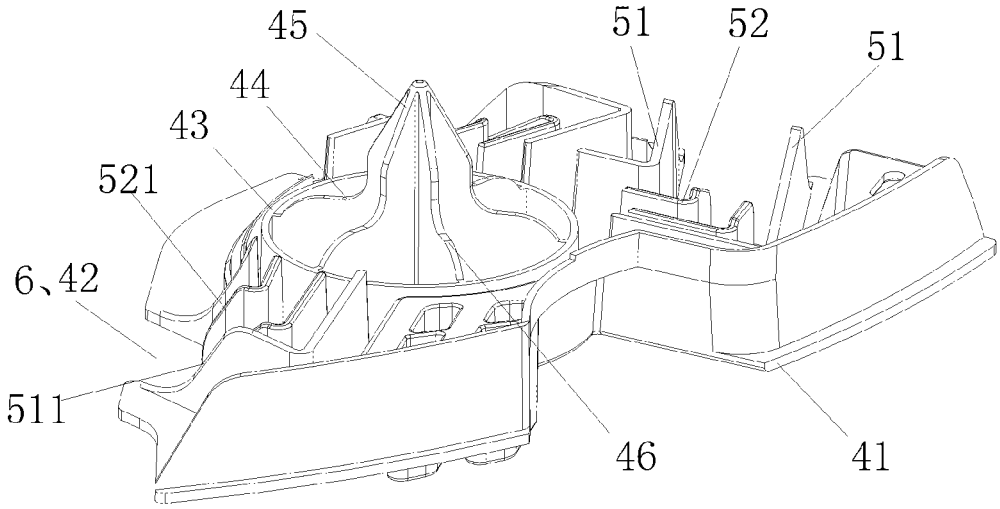
FIG. 3 is a schematic structural view of the filtering apparatus according to one embodiment of the present invention.

In certain embodiments, at least one notch 42 is defined at the opening of the groove 2 corresponding to the edge of the upper cover board 41. The notch 42 forms a water inlet 6 of the filtering passage (FIG. 1). A water outlet of the filtering passage is connected with the drainage port, and the filtering baffle extends from the water inlet of the filtering passage towards the water outlet. Edges 521, 511 of ends of the filtering baffle 52 and the sidewall baffle 51, which are close to the water inlet 6, are tilted (FIG. 3). In certain embodiments, they form smooth structures for lint to pass through easily, thereby preventing lint from being caught on the edges 521, 511.

Without intent to limit the scope of the invention, exemplary embodiments of the present invention are given below.

Embodiment 1

In the embodiment as shown in FIG. 3, the height of the filtering baffle 52 is less than or equal to the height of the sidewall baffle 51. The filtering apparatus is supported in groove 2 by the sidewall baffle 51. In certain embodiments, a gap 7 is defined between the lower end surface of the filtering baffle 52 and the bottom of groove 2. The height of gap 7 is less than or equal to about 3 mm. The structure enables drainage through the gap between the bottom of the filtering baffle and that of the groove, so as to increase the amount of drain water, and moreover, enables lint stopped by inclined edges 521, 511 of the filtering baffle 52 and the sidewall baffle 51 of the water inlet to be discharged with the water flow through the gap in the drainage port, and the gap can stop foreign materials from entrance and discharged.

Embodiment 2

In the embodiment as shown in FIGS. 3 and 5, an annular rib 43 is arranged corresponding to the drainage port on the lower surface of the upper cover board 41. The height of the annular rib 43 is less than that of the filtering baffle 52, multiple flow-guiding blades 44 are distributed radially from the center of the annular rib 43, and an end of the flow-guiding blade 44 has an arc-shaped transition corresponding to the annular rib. The structure prevents water flow from forming a vortex when the water enters the drainage port through the filtering passage, which results in an unstable drain water flow.

Embodiment 3

In the embodiment as shown in FIG. 5, a further improvement has been made based on Embodiment 2: the height of the flow-guiding blade 44 is greater than that of the annular rib 43, and is less than that of the filtering baffle 52.

Embodiment 4

Figure 2:
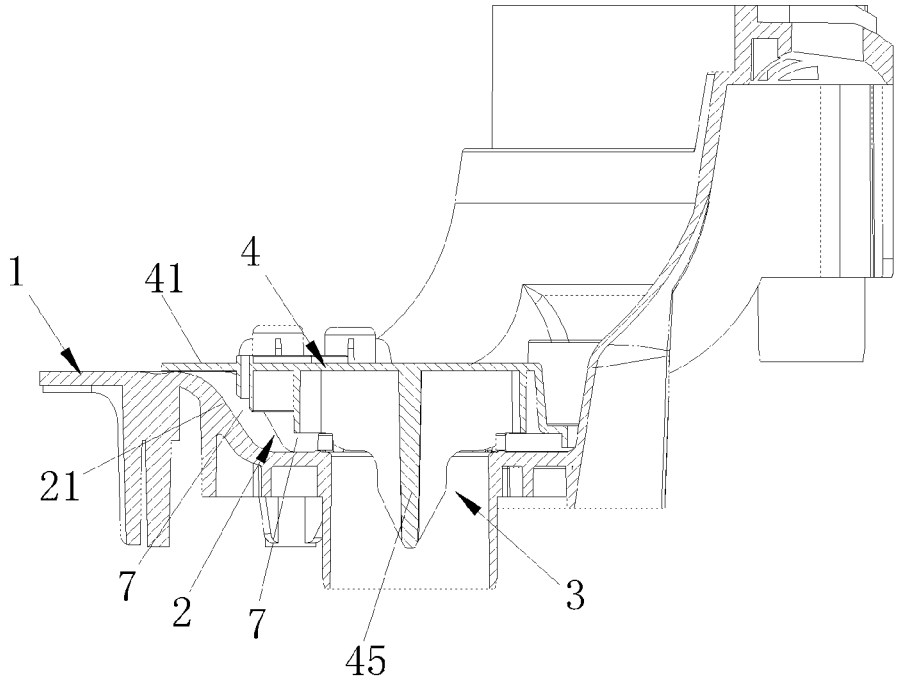
FIG. 2 is a schematic sectional view of the filtering apparatus mounted at the bottom of an outer barrel of a washing machine according to one embodiment of the present invention.

In the embodiment as shown in FIG. 3, the difference between this embodiment and Embodiment 3 lies in that: the flow-guiding blade 44 is highest at the intersection in the center, the height at the center is greater than that of the sidewall baffle 51, the height of the flow-guiding blade 55 decreases radially from the center towards the outside forming a tapered structure 45, which enters the drainage port 3 (FIG. 2). The annular rib 43 directly decreases to be flat 46 within one half to one third of the radius of the annular rib. The height of the flat portion 46 of the flow-guiding blade is less than or equal to that of the filtering baffle 52. The tapered structure further prevents lint that flows near the drainage port from entering the filtering passage again with a vortex water flow to cause a clog.

Embodiment 5

Figure 4:
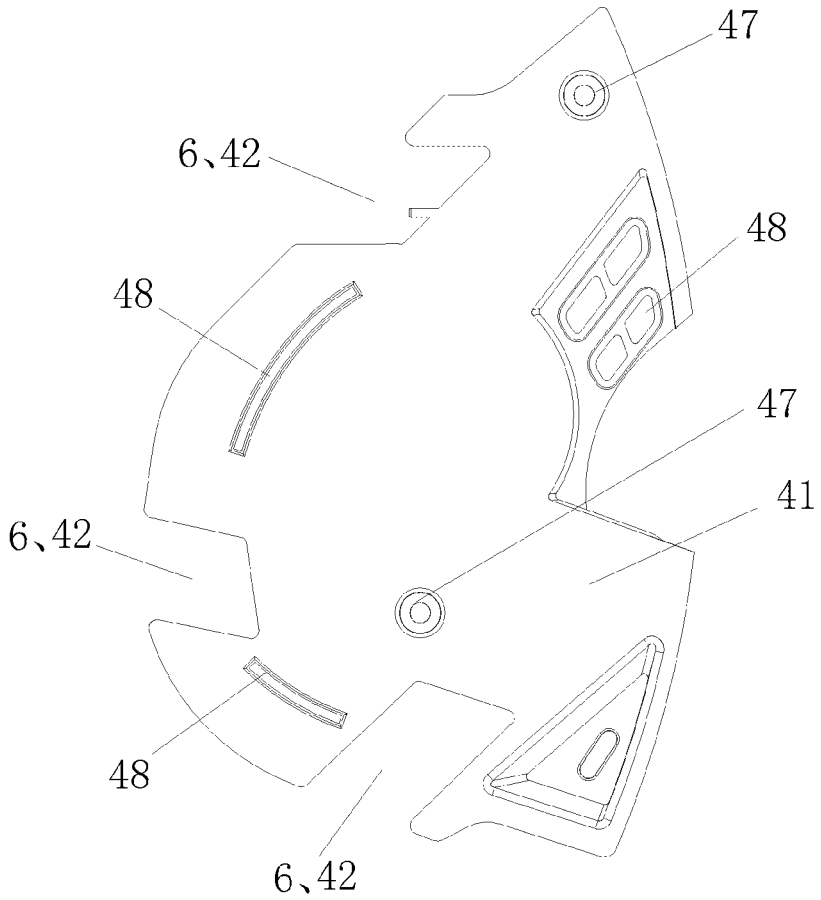
FIG. 4 is a schematic view of the upper surface of an upper cover board of the filtering apparatus according to one embodiment of the present invention.

In the embodiment, the filtering apparatus 4 is fixed in the groove 2 through a screw. A screw mounting column (not shown) for supporting the upper cover board of the filtering apparatus 41 is provided in the groove 2, and a screw hole 47 is correspondingly defined on the upper cover board 41 (FIGS. 1 and 4).

This embodiment and Embodiment 1 may be used in combination.

Embodiment 6

In the embodiment as shown in FIG. 2, a circumferential wall 21 of the groove 2 has a slope shape from top to bottom. The shape of the sidewall baffle 51 close to the circumferential wall of the groove is matched with that of the circumferential wall of the groove 21. In certain embodiments, the upper cover board 41 covers the opening of the groove 2. Alternatively, the upper cover board covers the circumferential wall of the slope-shaped groove, and the upper surface of the upper cover board is higher than the bottom surface of the inner barrel.

Embodiment 7

In the embodiment as shown in FIG. 4, at least one vertically-through drain water opening 48 is further provided on the upper cover board. A water inlet circumference of the drain water opening 48 protrudes from the upper surface of the upper cover board 41. The size of the drain water opening is relatively small and has an arc-shaped slit shape, a long strip shape or a small elliptical hole shape.

Embodiment 8

In one aspect, a washing machine with a drainage system of same includes a drainage port and a drainage valve or a drainage pump, and the filtering apparatus is provided above the drainage port. During drainage of the washing machine, the drainage system is turned on, water in an outer barrel enters the drainage port of the outer barrel from a water inlet of a filtering passage around the filtering apparatus and a drain water opening above an upper cover board. In the process of discharging water, the filtering apparatus of the present invention can effectively perform the filtering function.

The foregoing description of the exemplary embodiments of the invention has been presented only for the purposes of illustration and description and is not intended to be exhaustive or to limit the invention to the precise forms disclosed. Many modifications and variations are possible in light of the above teaching. Although not explicitly described in the present invention, other embodiments within the scope of the invention and defined by the claims may be obtained by combining, modifying or changing the exemplary embodiments as described in the present invention.

The exemplary embodiments were chosen and described in order to explain the principles of the invention and their practical application so as to activate others skilled in the art to utilize the invention and various exemplary embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. A drainage and filtering system for a washing machine, comprising:

an outer barrel; and a filtering apparatus, wherein a groove is defined at the bottom of the outer barrel, the bottom of the groove is provided with a drainage port, the filtering apparatus is mounted in the groove and covers an upper part of the drainage port, the filtering apparatus is provided with at least one filtering passage leading to the drainage port, and a foreign material stop structure is arranged in the at least one filtering passage, wherein the filtering apparatus comprises an upper cover board matched with a shape of an opening of the groove and multiple baffles arranged on a lower surface of the upper cover board, and the multiple baffles are matched to form a sidewall of the at least one filtering passage and the foreign material stop structure in the at least one filtering passage;

wherein the multiple baffles comprise a sidewall baffle for forming the sidewall of the at least one filtering passage and filtering baffles arranged in the at least one filtering passage, wherein a bent waterway in the at least one filtering passage is formed between one of the filtering baffles and the sidewall baffle, or between two adjacent filtering baffles of the filtering baffles, the bent waterway is matched with the filtering baffles to form the foreign material stop structure;

wherein a height of each of the filtering baffles is less than or equal to a height of the sidewall baffle, the filtering apparatus is supported in the groove by the sidewall baffle; and wherein an annular rib is provided at a lower surface of the upper cover board corresponding to the drainage port, a height of the annular rib is less than that of each of the filtering baffles, multiple flow-guiding blades are distributed radially from a center inside the annular rib, and an end of each of the multiple flow-guiding blades has an arc-shaped transition corresponding to the annular rib.

2. The drainage and filtering system for a washing machine according to claim 1, wherein the bent waterway is a single "<"-shaped bend or continuous bends, and the included angle of each "<"-shaped bend is about 40° to about 90°.

3. The drainage and filtering system for a washing machine according to claim 1, wherein at least one notch is defined at the opening of the groove corresponding to an edge of the upper cover board, the at least one notch forms a water inlet of the at least one filtering passage, a water outlet of the at least one filtering passage is connected with the drainage port, each of the filtering baffles extends from the water inlet of the at least one filtering passage towards the water outlet, and ends of the filtering baffles and the sidewall baffle close to the water inlet are smoothly sloped structures.

4. The drainage and filtering system for a washing machine according to claim 2, wherein a gap is defined between a lower surface of each of the filtering baffles and the bottom of the groove, and a height of the gap is less than or equal to about 3 mm.

5. The drainage and filtering system for a washing machine according to claim 1, wherein height of each of the multiple flow-guiding baffles is greater than that of the annular rib, and is less than that of each of the filtering baffles.

6. The drainage and filtering system for a washing machine according to claim 1, wherein the multiple flow-guiding baffles are highest at the intersection in the center, a height of each of the multiple flow-guiding baffles at the center is greater than that of the sidewall baffle, the height of each of the multiple flow-guiding baffles decreases radially from the center towards the outside, forming a tapered structure, which enters the drainage port; the annular rib directly decreases to be flat within one half to one third of the radius of the annular rib, and a height of a flat portion of each of the multiple flow-guiding baffles is less than or equal to that of each of the filtering baffles.

7. The drainage and filtering system for a washing machine according to claim 1, wherein the filtering apparatus is fixed in the groove through a screw.

8. The drainage and filtering system for a washing machine according to claim 1, wherein a circumferential wall of the groove has a slope shape or a step shape from top to bottom, a shape of the sidewall baffle close to the circumferential wall of the groove is matched with that of the circumferential wall of the groove, and the upper cover board covers the opening of the groove.

9. The drainage and filtering system for a washing machine according to claim 1, wherein at least one vertically-through drain water opening is further provided on the upper cover board, and a water inlet circumference of a drain water opening protrudes from an upper surface of the upper cover board.

* * * * *